United States Patent [19]

Redding et al.

[11] Patent Number: 5,024,573

[45] **Date of Patent: * Jun. 18, 1991**

[54] LIFTING DEVICE

[75] Inventors: John W. Redding, Brookfield; Robert F. Zelinka, Roselle, both of Ill.

[73] Assignee: Perkins Manufacturing Company, Chicago, Ill.

[ * ] Notice: The portion of the term of this patent subsequent to May 3, 2005 has been disclaimed.

[21] Appl. No.: 272,765

[22] Filed: Nov. 17, 1988

Related U.S. Application Data

[63] Continuation-in-part of Ser. No. 126,593, Nov. 30, 1987, Pat. No. 4,911,600, which is a continuation of Ser. No. 862,015, May 12, 1986, Pat. No. 4,741,068, which is a continuation of Ser. No. 572,389, Jan. 20, 1989, abandoned.

[51] Int. Cl.[5] ..... B65F 3/02

[52] U.S. Cl. ..... 414/408; 414/786; 414/421

[58] Field of Search ..... 414/406, 407, 408, 411, 414/404, 405, 419, 420, 421, 422, 423, 424, 425, 786, 539, 540, 541, 546, 555, 558

[56] References Cited

U.S. PATENT DOCUMENTS

| | | | |
|---|---|---|---|
| 3,732,997 | 5/1973 | Reavis et al. . | |
| 3,738,516 | 6/1973 | Wells . | |
| 3,804,277 | 4/1974 | Brown et al. . | |
| 3,884,376 | 5/1975 | Rivers . | |
| 3,894,642 | 7/1975 | Shive . | |
| 4,042,137 | 8/1977 | Hughes et al. . | |
| 4,365,922 | 12/1982 | Borders | 414/406 |
| 4,422,814 | 12/1983 | Borders | 414/303 |
| 4,479,751 | 10/1984 | Wyman et al. | 414/406 |
| 4,673,327 | 6/1987 | Knapp | 414/408 |
| 4,741,658 | 5/1988 | Zelinka et al. | 414/406 |
| 4,773,812 | 9/1988 | Bayne et al. | 414/408 |

FOREIGN PATENT DOCUMENTS

| | | | |
|---|---|---|---|
| 622499 | 6/1961 | Canada . | |
| 811456 | 8/1951 | Fed. Rep. of Germany . | |
| 2146653 | 3/1973 | Fed. Rep. of Germany . | |
| 3024081 | 1/1981 | Fed. Rep. of Germany . | |
| 2479783 | 10/1981 | France | 414/408 |
| 2500425 | 8/1982 | France | 414/408 |
| 8303242 | 9/1983 | PCT Int'l Appl. . | |

OTHER PUBLICATIONS

Refuse Removal Systems, Inc., "Waste Wheeler", *Waste Age*, Mar., 1982. Rubbermaid, Mobile Toter.

*Primary Examiner*—Frank E. Werner
*Attorney, Agent, or Firm*—Cook, Egan, McFarron & Manzo, Ltd.

[57] ABSTRACT

A lifter to empty a container into a cavity of a vehicle. The lifter is movably mounted below a sill edge of the cavity, so that the lifter is beneath the vehicle when not in use. The lifter has hooks to grasp bars on the container. The lifter has devices for moving from a position beneath the vehicle to a position above the cavity for dumping the container. The lifter has devices for capturing the lower bar of the container which automatically compensates for out-of-tolerance parts in the lifter due to such things as construction or wear.

14 Claims, 5 Drawing Sheets

FIG. 1
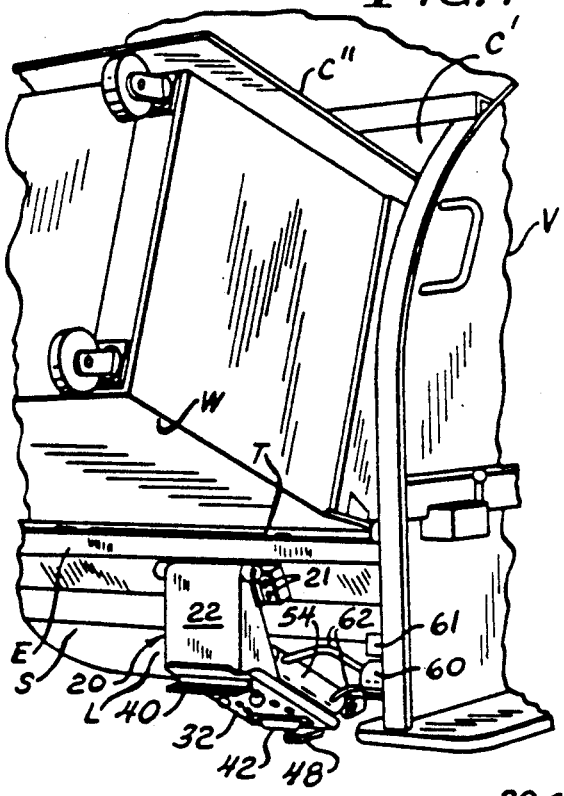
FIG. 2
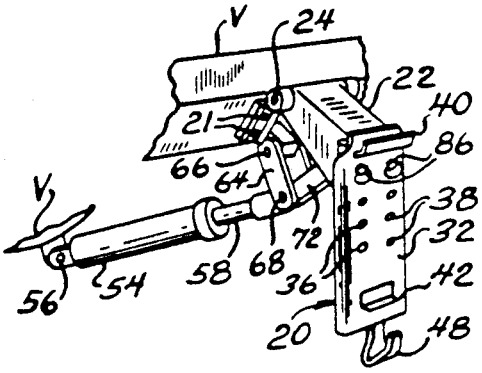
FIG. 5
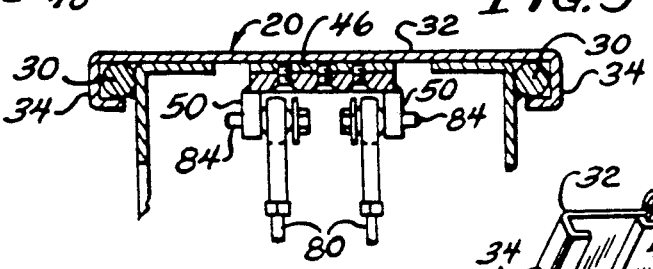
FIG. 3
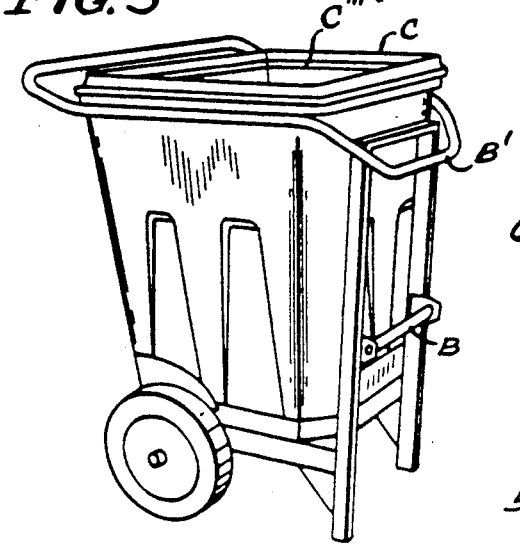
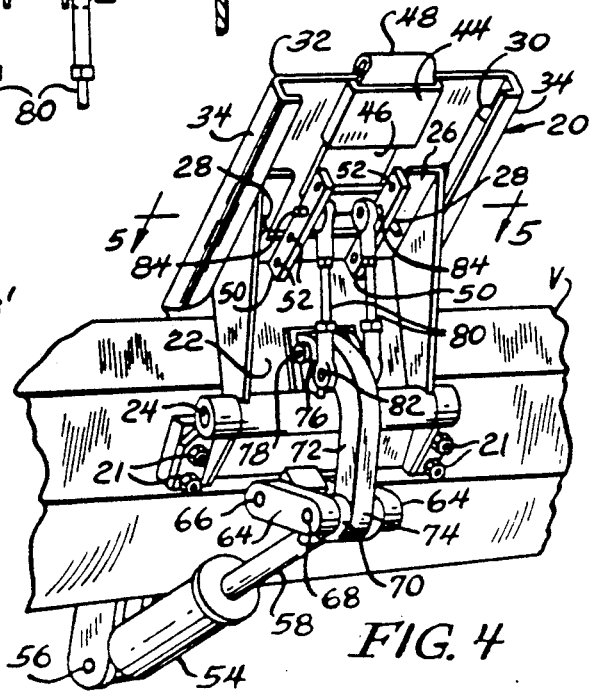
FIG. 4

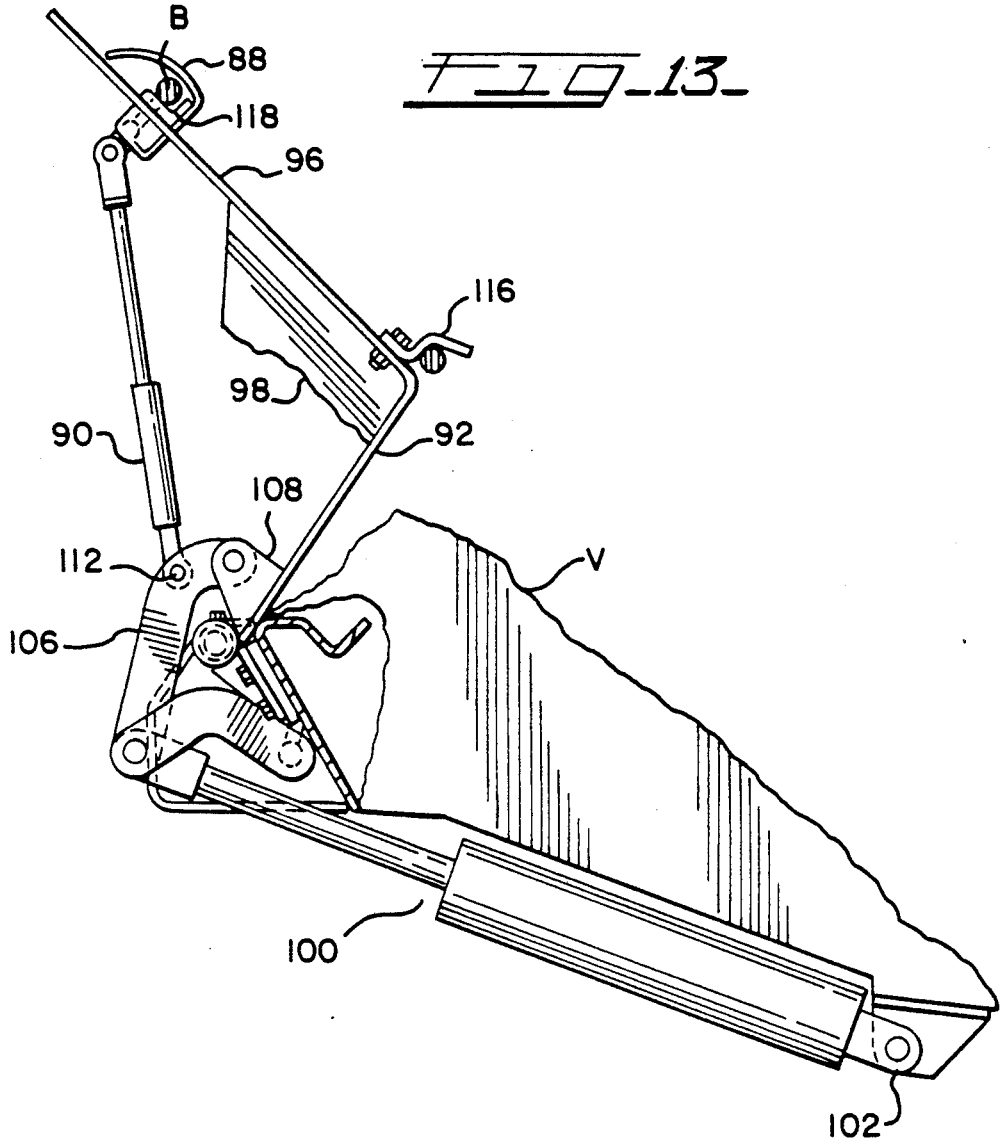
FIG. 13
FIG. 14
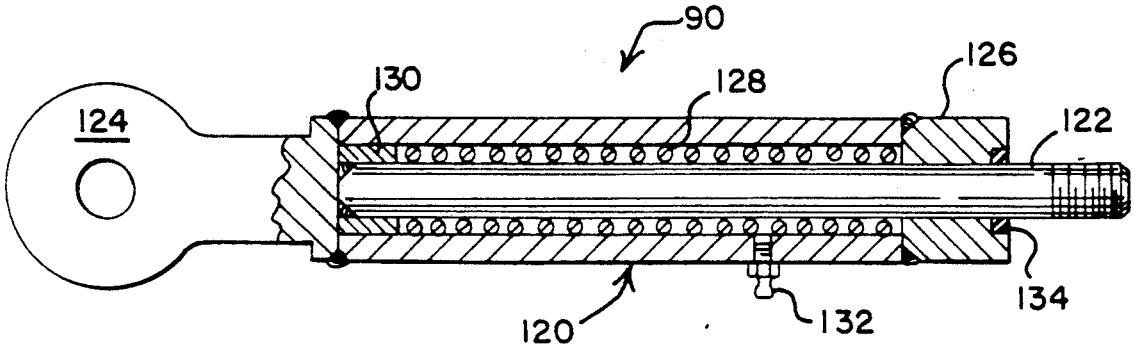

LIFTING DEVICE

BACKGROUND OF THE INVENTION

This application is a continuation-in-part of prior co-pending application Ser. No. 126,593 filed Nov. 30, 1987, now U.S. Pat. No. 4,911,600; which is a continuation of prior application Ser. No. 862,015, filed May 12, 1986, now U.S. Pat. No. 4,741,068, which was a continuation of prior application Ser. No. 572,389, filed Jan. 20, 1984, now abandoned.

The present invention relates to lifting devices for refuse collection vehicles and the like.

Before the present invention, lifting devices have been proposed for emptying containers into the cavity of a vehicle, such as refuse trucks. An initial problem with prior devices is that they are large and cumbersome. Also, the prior lifters have prevented access to the vehicle for pivot dumping large rear loading containers. One prior device folds to a side of the vehicle to permit access to the vehicle, but the device obstructs traffic in this position.

SUMMARY OF THE INVENTION

A principal feature of the present invention is the provision of an improved lifter emptying container into a cavity of a vehicle which does not interfere with access for pivot dumping large rear loading containers.

In a preferred embodiment, the lifter of the present invention comprises a first plate pivotally mounted to the vehicle and a second plate extending at an angle from the first plate. The lifter has a third plate mounted on the second plate, with the third plate having a pair of spaced hooks. The lifter has means for driving the plates and hooks between a first lower, retracted position to a series of second upper position.

A feature of the present invention is that in the first position the lifter is located beneath the vehicle.

Thus, a feature of the present invention is that when the lifter is at the first position access is permitted to the vehicle in order to dump a large rear loading container into the vehicle.

Another feature of the invention is that the hooks grasp bars on the container as the lifter moves between the first and second positions.

Yet another feature of the invention is that the lifter places the container above the cavity at the second position in order to empty the container into the vehicle cavity.

A further feature of the invention is that one of the hooks clamp on the container bar to prevent the container from falling into the cavity while it is being emptied.

Still another feature of the invention is that the hooks are adjustable in height on the lifter.

Thus, a further feature of the invention is that the lifter may be adjusted to accommodate changes in the truck as refuse is dumped into the vehicle or differences in height when the vehicle is located on a hill.

Further features will become more fully apparent in the following description of the embodiments of this invention and from the appended claims.

DESCRIPTION OF THE DRAWINGS

In the drawings:

FIG. 1 is a fragmentary perspective view illustrating a lifter of the present invention in a first lower position;

FIG. 2 is a fragmentary perspective view of the lifter of FIG. 1;

FIG. 3 is a perspective view of a container which is emptied into a vehicle by the lifter of the present invention;

FIG. 4 is a fragmentary perspective view of the lifter in a second upper position;

FIG. 5 is a fragmentary sectional view taken substantially as indicated along the line 5—5 of FIG. 4;

FIG. 13 is a fragmentary perspective view illustrating an alternative embodiment of the present invention in the second upper position; and FIG. 14 is a fragmentary sectional view of a self-tensioning rod taken substantially as indicated along the line 14—14 of FIG. 13.

DESCRIPTION OF THE PREFERRED EMBODIMENTS

Figure 6:
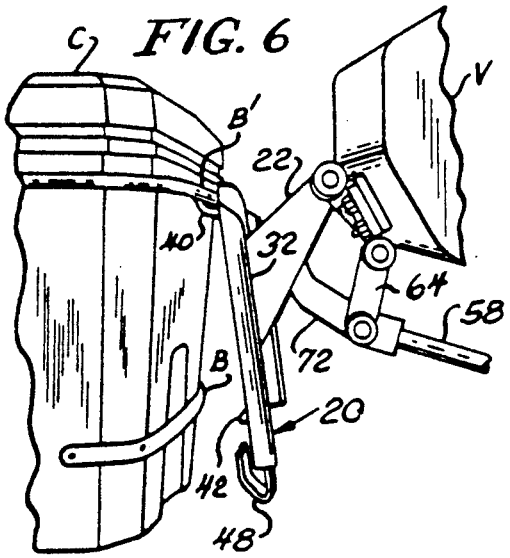
FIGS. 6–8 are fragmentary perspective views illustrating the lifter in operation to empty the container into the vehicles.

Referring now to FIG. 1, there is shown a lifter 20 of the present invention which is mounted by bolts 21 on the rear of a vehicle V such as a refuse truck. Although the lifter 20 is shown mounted on the right rear side of the vehicle V, it will be understood that another lifter of the same type may be mounted on the left side of the vehicle V. The vehicle V has a hopper container sill S defining a lower portion of a rearwardly facing opening to the cavity C′ to receive and retain refuse. The sill S has a lower portion L slanting upwardly and rearwardly to a leading sill edge E over which the refuse is dumped. As shown in FIG. 1, the lifter 20 is located at a first, or lower, position beneath the sill S of the vehicle V, with the lifter 20 being mounted by the bolts 21 adjacent but beneath the edge E of the sill S to permit horizontal access to the edge E from the edge E to the ground. The lifter 20 of the present invention is utilized to empty a first type of containers C of FIG. 3 into the cavity C′ of the vehicle V of a type which are too short to matingly engage the sill and thus must be lifted above the sill. With reference to FIG. 1, with the lifter 20 in its lower, or retracted position the lifter 20 is located sufficiently beneath the sill S, such that access at a level vertically beneath the edge E to the ground is permitted to the rear sill S at the of the vehicle in order to empty large, rear-loading containers C″ of the type which are tall enough to be unloaded by tilting without lifting, as shown in FIG. 1, in a tilted position. Before and after dumping of the container C″ extends substantially vertically from the sill edge E toward the ground. The container C″ has an elongated trunnion bar T at an uppermost portion of the container C″ which is located adjacent to the sill edge when the container C″ is dumped, as shown in FIG. 1. Thus, in accordance with the present invention, the lifter 20 lifts and tilts small containers without interfering with the emptying of both small and large containers into the vehicle V.

With reference to FIG. 3, the container C with which the lifter 20 operates has a lower front bar B and an upper front bar B'. The container C has a chamber C'' with an open top into which refuse is dumped by the user for storage until the container C is emptied into the vehicle V of FIG. 1.

With reference to FIGS. 1, 2, 4, and 5, the lifter 20 has a first plate 22 having an inner end pivotally connected at 24 to the rear of the vehicle V adjacent the cavity C'. The lifter 20 has a second plate 26 extending therethrough for a purpose which will be described below. Also, the second plate 26 has a pair of spaced rods 30 at opposed sides of the second plate 26 and extending along the second plate 26.

The lifter 20 has a third plate 32 having a pair of flanges 34 at opposed sides of the third plate 32 and partially extending around the rods 30 of the second plate 26, such that the third plate 32 is slidably mounted on the second plate 26. The third plate 32 has a first set of openings 36 aligned along the third plate 32, and a second set of openings 38 aligned along the length of the third plate 32, such that the openings 36 and 38 register with the apertures 28 of the second plate 26. The third plate 32 has an upper outwardly directed hook or hook member 40 adjacent an inner end of the third plate 32. The third plate 32 also has an outwardly directed flange 42 adjacent an outer end of the third plate 32.

The third plate 32 has an inner tunnel 44 adjacent an outer end of the third plate 32. The third plate 32 has hook means comprising a tongue 46 slidably received in the tunnel 44, and a hook or hook member 48 extending from an outer end of the tongue 46 and being directed toward the flange 42. The lifter 20 has a pair of elongated opposed flanges 50 connected to an inner end of the tongue 46, with the flanges 50 having a plurality of apertures 52 spaced along their length.

The lifter 20 has a hydraulic cylinder 54 having one end pivotally connected at 56 beneath the vehicle. The cylinder 54 has a piston 58 which may move in and out of the cylinder 54. The piston 58 of the cylinder 54 is driven by a pump 60 through conduits 62, with the pump 60 being driven by a motor 61 which is powered by the electrical system of the vehicle V.

The lifter 20 has a pair of link arms 64 each having an inner end pivotally connected at 66 to the vehicle V, and an outer end pivotally connected at 68 to an outer end 70 of the piston 58. The lifter 20 has an arcuate arm 72 having one end 74 pivotally connected to the outer end 70 of the piston 58 and outer ends of the link arms 64 at connection 68, and the other end 76 pivotally connected at 78 to an inner end of the first plate 22.

The lifter 20 has a pair of rods 80 having one end pivotally connected at 82 to a central portion of the arcuate arm 72 intermediate the pivotal connections 68 and 78. The other ends of the rods 80 have pins 84 which are pivotally received in selected apertures 52 of the flanges 50.

Figure 7:
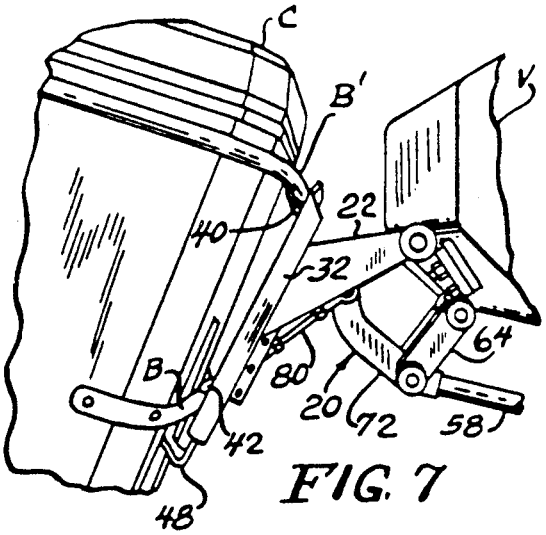
Figure 8:
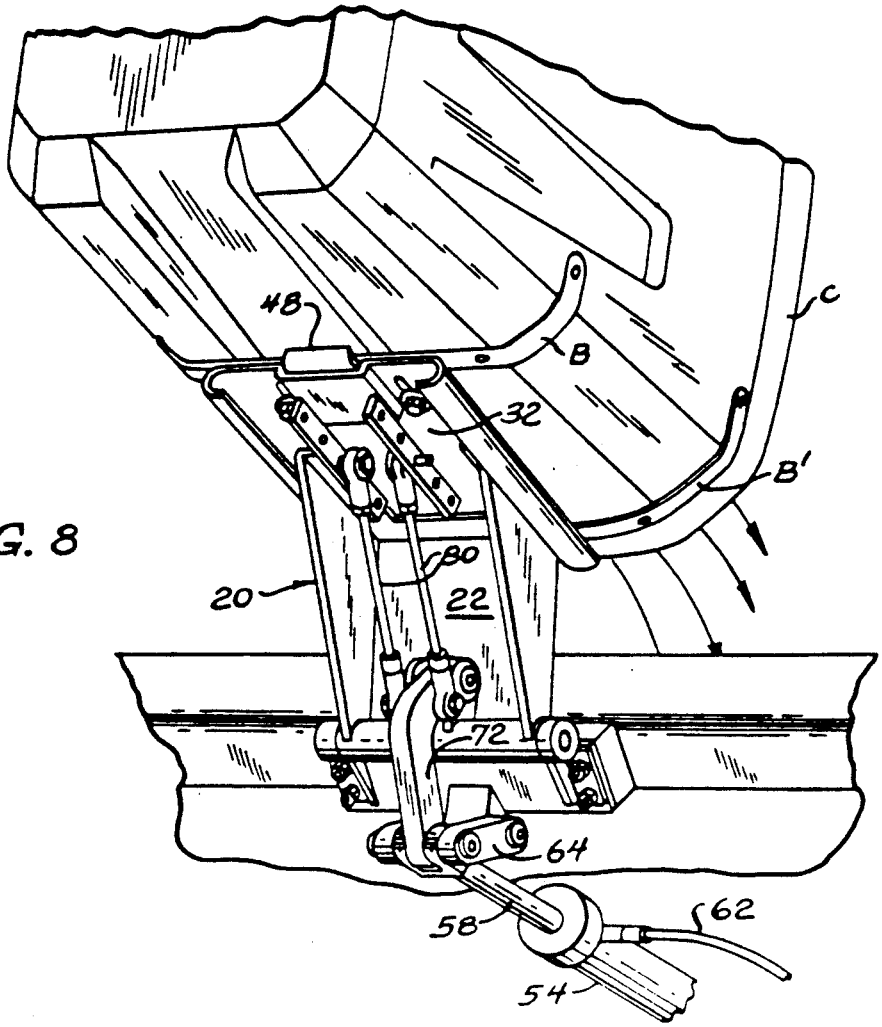

In operation, the lifter 20 is initially located in a first lower position beneath the vehicle V, as shown in FIG. 1. In this configuration, the hook 48 is spaced from the flange 42. Prior to use of the lifter 20, the container C of FIG. 3 is moved to a position behind the lifter 20. With reference to FIG. 6, as the cylinder 54 is operated by the pump 60 and motor 61 to drive the piston 58 out of the cylinder 54, the lifter 20 moves from beneath the truck and the hook 40 initially catches the upper bar B' of the container C. With reference to FIG. 7, as the piston 58 is driven further from the cylinder 54, the lower bar B of the container C is received between the hook 48 and the flange 42. Next, as the cylinder 54 further drives the lifter 20 in an upward direction, the hook 48 moves toward the flange 42 in order to clamp the lower bar B of container C between the hook 48 and flange 42 and prevent the container C from falling into the cavity C' of the vehicle V. Finally, with reference to FIG. 8, the lifter 20 is driven to a second upper position with the container C located above the cavity C' of the vehicle V in an upside down orientation in order to empty the container C into the cavity C' of the vehicle V. After the container C has been emptied into the vehicle V, the lifter 20 is driven from the second upper position to the first lower position while the hook 48 moves away from the flange 42 in order to release the lower bar B of the container C. In this manner, the lifter 20 of the present invention may be readily and simply used in order to empty the container C into the cavity C' of the vehicle V.

Figure 9:
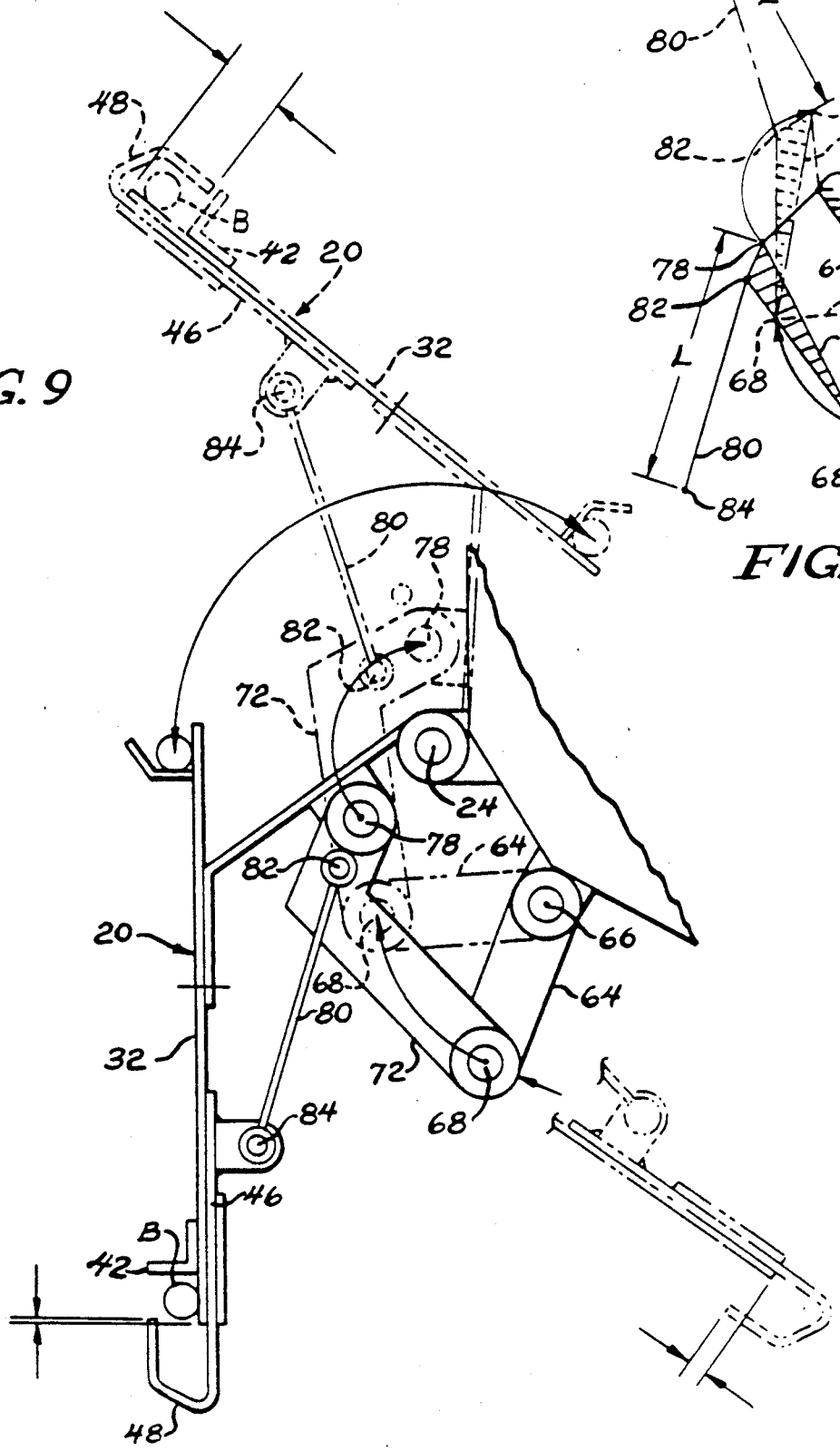
FIGS. 9 and 10 are diagrammatic views illustrating operation of the lifter of the present invention.
Figure 10:
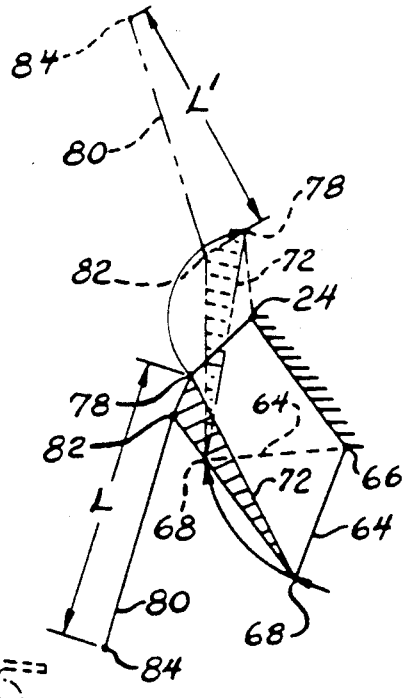
Figure 11:
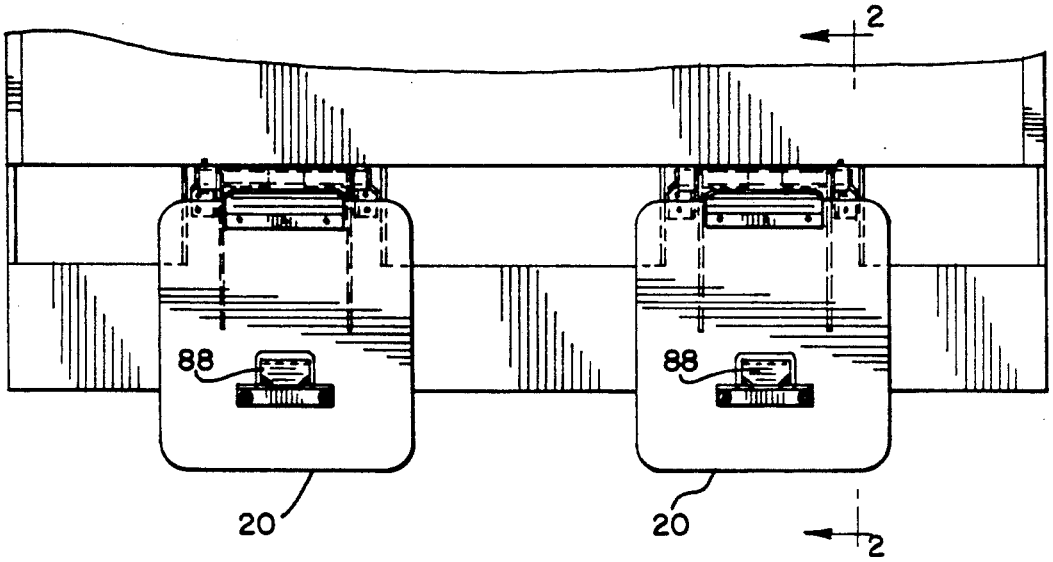
FIG. 11 is a view from the back of a truck illustrating an alternative embodiment of the present invention in an intermediate position between the first lower position and the second upper position.

The manner in which the hook 48 is moved toward and away from the flange 42 during movement of the lifter 20 will be discussed in connection with FIGS. 9 and 10 where the lifter 20 is shown in solid lines in a lower position and in dotted lines in an upper position. As shown, the pivotal connections 78, 82, and 84 are located on nearly a straight line at the lower position of the lifter 20 and define a distance L between the connections 78 and 84. In the upper position of the lifter 20, the connections 78, 82, and 84 form a triangle to define the distance L'. Therefore, it will be apparent that the distance L' between the connections 78 and 84 is less in the upper position of the lifter 20 than the distance L in the lower position of the lifter 20. Accordingly, the rods 80 pull on the tongue 46 as the distance between connections 78 and 84 lessens while the lifter 20 rises, and the tongue 46 moves the hook 48 over the bar B as the lifter 20 rises and the distance L shortens. In this manner, the hook 48 is clamped on the bar B as the lifter 20 moves toward its upper position. In a preferred form, the hook 48 clamps on the bar B when the lifter 20 is approximately in a horizontal position. In reverse, as the lifter 20 lowers from its upper position the distance L' increases and the rods 80 move the tongue 46 and hook 48 toward an outer position in order to release the bar B. In this matter, the lifter 20 of the present invention clamps the bar B of the container C as the lifter rises to its second upper position in order to prevent the container from falling into the cavity , C' of the vehicle as the container C is emptied.

As refuse is placed in the cavity C' of the vehicle V, the vehicle V settles and the height of the hooks 48 and 40 may change with respect to the bars of the container C. Also, when the vehicle is placed on a hill, the height of the hooks 48 and 40 may change relative to the bars of the container C. In accordance with the present invention, the height of the hooks 48 and 40 may change relative to the bars of the container C. In accordance with the present invention, the height of the hooks 48 and 40 may be adjusted relative to the bars B and B' of the container C to accommodate these changes. The openings 36 and 38 of the third plate 32 may be selectively positioned in register with the apertures 28 of the second plate 26 as the third plate 32 is slid relative to the second plate 26. Once the selected openings 36 and 38 are in register with the apertures 28, a pair of pins 86 are placed through the openings 36 and 38 and the apertures 28 in order to retain the third plate 32 in place relative to the second plate 26. Prior to adjustment of the third plate 32, the pins 84 of the rods 80 are removed from the apertures 52 of the flanges 50, and the pins 84 are then inserted into different apertures 52 of the flanges 50 depending upon the location of the third plate 32. Of course, the position of the hooks 48 and 40 are fixed with respect to the third plate 32, and thus the height of the hooks 48 and 40 are adjusted relative to the container C through adjustment of the position of the third plate 32 in the manner described.

Thus, in accordance with the present invention, the lifter 20 may be positioned beneath the vehicle V to permit access to the vehicle V and empty large rear loading containers into the vehicle V. Also, the lifter 20 grasps a container C during movement to a second upper position in order to empty the container C into the vehicle V. In accordance with the invention, the lifter 20 has a hook 48 which clamps on a bar B of the container C curing upward movement of the lifter 20, in order to prevent the container C from falling into the cavity C' of the vehicle V as the container C is being emptied, and the hook 48 automatically releases the bar B of the container C as the lifter 20 moves from its upper to lower position. Also, the height of hooks 48 and 40 of the lifter 20 may be adjusted relative to the bars B and B' of the container C such that the hooks 48 and 40 appropriately grasp the bars B and B' on the container C curing operation of the lifter 20.

Figure 12:
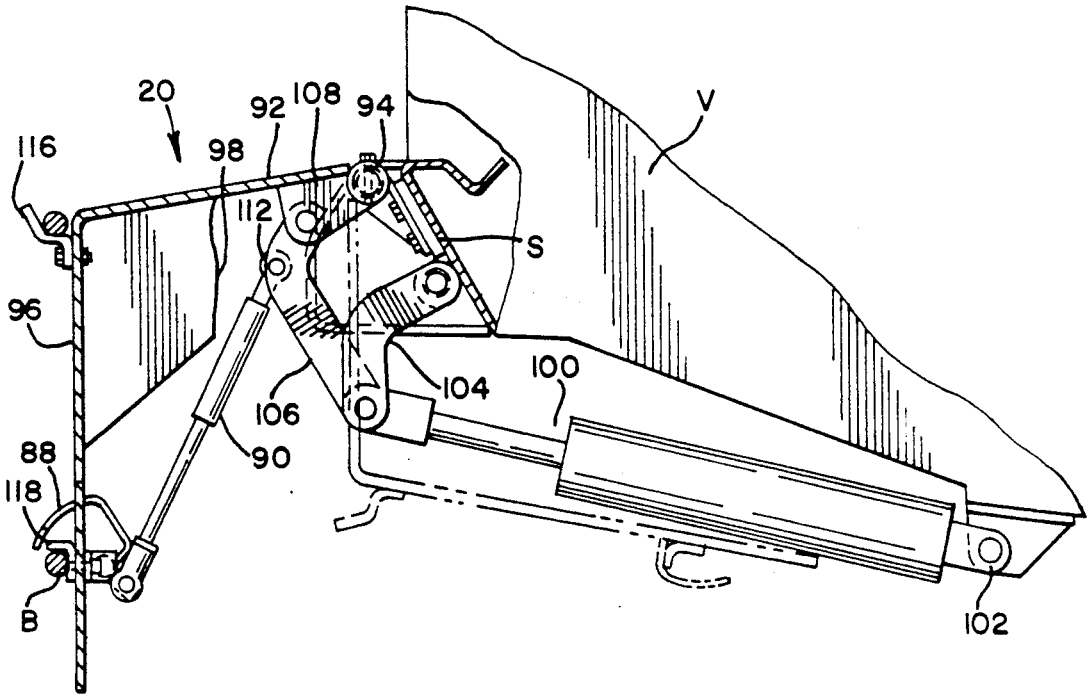
FIG. 12 is a fragmentary perspective view illustrating an alternative embodiment of the present invention in an intermediate position, and, in phantom lines, in the first lower position.

FIGS. 11–14 depict an alternative embodiment of the present invention which utilizes a pivotally mounted hook 88 for capturing the lower bar B of the container C. To accommodate dimensional variations which may occur in construction of the lifter or which may arise due to wear, a variable length means, such as variable length connector 90, is provided for pivoting the hook 88 between a capture or latch position (as shown in FIG. 13) and an open or release position (as shown in FIG. 12).

Referring to FIG. 12, the lifter 20 of this embodiment has many of the same features as were described in connection with the first-recited embodiment. The lifter has a flat plate portion 92 which is pivotally connected at 94 to the rear of vehicle V generally adjacent and below the sill S of cavity C'. An additional or second flat plate portion 96 is attached, as by welding, to the outer or distal end of the first plate 92, and extends at an angle of approximately 90° or slightly greater to the first plate. To provide reinforcement, two generally triangularly shaped plates 98 are welded to the underside of the first and second plates.

As with the earlier-described embodiment, for pivoting the lifter between a retracted position (in dashed lines in FIG. 11) and an extended position (FIG. 13), the lifter includes a hydraulic piston/cylinder combination 100 having one end pivotally connected at 102 beneath the vehicle. As with the prior embodiment, the hydraulic cylinder is preferably driven by a pump through conduits in a manner earlier described and well-known to those skilled in the field.

The hydraulic piston/cylinder combination 100 moves the lifter through a system of linkages best shown in FIGS. 12 and 13. A first link 104 is pivotally attached to the vehicle V at one end, and to a second link 106 at the other end. The second link 106 is also pivotally attached to a bracket 108 mounted on the underside of plate 92. The first link 104 in the illustrated embodiment is angled to conform to the depicted underside of the vehicle V when the lifter is in the retracted position. The second link is also angled or arcuate to provide means for pivoting the hook 88 between the capture and release positions. As shown in FIG. 12, connector 90 is pivotally attached at one end 112 to the second link 106. The other end of the connector is pivotally attached at 114 to the hook 88. Preferably, the pivotal attachment point 112 of the connector 90 to the second link is at a location spaced from an imaginary line connecting the end pivot points of the second link. With this attachment point, movement of the lifter between retracted and extended positions results in a pulling or pushing force on the connector (as described earlier with respect to FIG. 10) and movement of the hook between an open or release position and a closed or capture position.

For engaging and lifting a container C, the lifter preferably includes a fixed, upwardly extending hook 116 for engaging under the upper bar B' of the container so as to lift the container as the lifter is moved from the retracted to the extended position. To prevent the container C from disengaging from the lifter when it is inverted for discharge of the contents (see FIG. 13), a lower stop, such as an angle-iron bracket 118, is provided on plate 96, against which the lower bar B of the container C engages when the container is inverted.

To capture the lower bar B against the stop 118 and prevent accidental disengagement, the lifter includes the pivotally mounted hook 88. The hook preferably is curved at one end for capturing the bar B and is pivotally attached to the connector 90 at the other end. The hook 88 is preferably pivotally mounted (at a point intermediate the ends) on the backside of plate 96 for pivotal movement of the curved end portion through an aperture in the plate between a retracted position, such as shown in FIG. 12, and a capture position, such as shown in FIG. 13. As seen in FIG. 12, the hook, when in the open or release position, is pivoted upwardly and away from the stop 118. In the capture position, the hook is pivoted downwardly toward the stop, and may rest against the stop, with the curved end portion of the hook overlying and generally capturing the bar B against accidental dislodgement of the container.

As noted earlier, the hook 88 is pivoted between the capture and release positions by variable length connector 90. To accommodate variations in dimensions which may occur during construction or during use, the connector 90 is preferably of variable length or extensible to avoid imposing undue stress on the hook 88. An example of how undue stress may arise, as will be seen in FIG. 13, when in the capture position, the hook may engage against the stop 118. If the connector 90 were of rigid construction, and variations during construction of the lifter resulted in the hook engaging the stop prior to the lifter reaching the end of its upward travel, further upward movement of the lifter would result in very large forces being applied to the connector and the hook resulting in possible bending or fracture of the hook or possible fracture of one or more of the component parts of the hook or the connector.

To avoid placing too great a stress on the hook, the connector 90 is preferably extensible or of variable length. Although various means may be used for providing variability in length, in the preferred embodiment, connector 90 is spring-loaded to allow it to increase in length and is constructed in a manner depicted in detail in FIG. 14. As shown there, the connector 90 comprises a cylindrical housing, generally at 120, and an axially movable rod 122. The housing 120 has an attachment eye 124 welded at one end, and a cap or cover 126 welded at the other end, with an aperture therein through which the rod 122 may move. The rod is preferably spring-loaded by a spring 128 located between the cover 126 and a sleeve 130 which is welded to the interior end of rod 122. The spring is preferably pre-compressed to exert a force on the rod of approximately 30 lbs. The spring constant is preferably about 30 lbs./inch.

To reduce friction between the rod 122 and the housing 120, the interior of the housing 120 may be packed with lubricating grease or its equivalent as is well-known in the art. To allow periodic injection of grease into the housing 120, a grease fitting 132, as is well-known in the art, may be provided in housing 120. An annular grease seal 134 is provided on the aperture cover 126, serving to retain the grease in the housing 120 while permitting the rod 122 to slide through the grease seal 134 relative to the housing 120. In the preferred embodiment, the annular grease seal is made of an elastomeric or resilient material such as rubber. Any other suitable seal material compatible with grease may, however, be substituted without departing from the spirit of the invention.

The length of the entire connector 90 is such that when the lifter 20 is pivoted from the retracted position to an intermediate position, such as shown in FIG. 12, where it engages and begins to lift a container C, the rod exerts a pushing force on the hook 88, moving it upwardly and away from the stop to allow rod B to engage or nest against the stop 118. Upon further rotation of the lifter upwardly to a tilting position, the second link 108 exerts a pulling force on the connector 90, causing the hook 88 to pivot downwardly over the stop 118 and bar B, and capturing the bar in a position against the stop from which it cannot inadvertently dislodge, as shown in FIG. 13.

In the event variations in dimensions arise during construction of the dumper or from use which result in the hook engaging against the stop prior to the lifter reaching its end of upward travel, further rotation of the dumper upwardly will result in the connecting rod 90 being extended, via compression of the spring, thereby holding the hook tightly in the capture position but without inducing unnecessary stress which would result in bending or fracture of the hook or other components.

In operation, this embodiment of the lifter 20 is initially located in a first lower position beneath the vehicle V, as best seen in FIG. 12, in the phantom lines. Prior to use of the lifter 20, the container C of FIG. 3 is moved to a position behind the lifter 20. With reference to FIG. 12, as the cylinder 100 is operated by the pump 60 and motor 61 to drive the piston out of the cylinder, the lifter 20 moves from beneath the truck and the hook 116 initially catches the upper bar B' of the container C. Next, as the cylinder 100 drives the lifter in an upward direction, the motion of hook 88 rotates downwardly over stop 118 and over the lower bar B of the container C without hitting container C. The latching of hook 88 prevents the container C from falling from the lifter during continued rotation of the lifter to an inverted position.

Finally, with reference to FIG. 13, the lifter 20 is driven to a second position with the container C located above the cavity C' of the vehicle V in an upside-down orientation in order to empty the container C into the cavity C' of the vehicle V. After the container C has been emptied into the vehicle V, the lifter 20 is driven from the second upper position to the first lower position while the hook 88 rotates upwardly over the lower bar B of the container C. In this manner, the lifter 20 of the alternative embodiment of the present invention may be readily and simply used in order to empty the container C into the cavity C' of the vehicle V.

The foregoing detailed description is given for clearness of understanding only, and no unnecessary limitations should be understood therefrom, as modifications will be obvious to those skilled in the art.

What is claimed is:

1. A refuse collection vehicle comprising:

means defining a refuse receiving cavity, including sidewalls and a floor extending upwardly to a lower sill edge;

a receptacle lifter movably mounted below said sill, said lifter including means for capturing a portion of a selected type of receptacle;

means cooperatively associated with said lifter for moving said lifter between a first lifter position and a second lifter position, said lifter being located substantially entirely below a horizontal plane tangent to said sill edge and substantially entirely on the cavity side of a vertical plane tangent to said sill edge when in said first lifter position, wherein lateral access to said sill edge from a side of said vertical plane opposite said refuse receiving cavity is substantially unobstructed and said second position being above said sill edge for dumping a selected type of receptacle;

said means for capturing a portion of a selected type of receptacle being movable between a capture position for capturing a portion of the selected type of receptacle and a release position for releasing the receptacle portion; and means cooperatively associated with said lifter moving means and said capture means for moving said capture means between said first and second positions, including automatically adjusting variable length means connecting said capture means and said moving means, said automatically adjusting variable length connecting means being resiliently biased to a reduced length position.

2. A refuse collection vehicle in accordance with claim 1 wherein said capture means comprises means pivotally-mounted for movement around the portion of the selected type of receptacle in the capture position.

3. A refuse collection vehicle in accordance with claim 1 wherein said automatically adjusting variable length means comprises a connector having a rod movable between a retracted position and an extended position and means resiliently biasing said rod toward said retracted position.

4. A refuse collection vehicle in accordance with claim 3 wherein said automatically adjusting variable length means further comprises means housing one end of said rod and said resiliently biasing means, the other end of the rod being pivotally connected to selected of said capture means and said moving means and said housing means being connected to the other of said capture means and said moving means.

5. A refuse collection vehicle in accordance with claim 3 wherein the biasing means is a spring exerting approximately 30 pounds of biasing force on said rod.

6. Receptacle dumping apparatus attachable to a refuse collection vehicle of the type having a refuse collection vehicle of the type having a refuse receiving cavity including sidewalls and a floor extending upwardly to a lower sill, said dumping apparatus comprising:

a receptacle lifter comprising means for capturing and releasing a portion of a selected type of receptacle;

means for movably mounting said receptacle lifter below the sill of the refuse collection vehicle;

means for moving said lifter between a first lifter position and a second lifter position, said lifter being located substantially entirely below a horizontal plane tangent to said sill edge and substantially entirely on the cavity side of a vertical plane tangent to said sill edge when in said first position, and said second position being above the sill for dumping a selected type of receptacle;

said means for capturing and releasing a portion of a selected type of receptacle being movable between a capture position for capturing a portion of the selected type of receptacle and a release position for releasing the receptacle portion;

means cooperatively associated with said lifter moving means and said capture means for moving said capture means between said release and capture positions as said lifter moves between said first and second lifter positions, including automatically adjustable variable length means connecting said capture means and said moving means, said automatically adjusting variable length connecting means being resiliently biased to a reduced length position.

7. A receptacle dumping apparatus in accordance with claim 6 wherein said capture means comprises means pivotally-mounted for movement around the portion of the selected type of receptacle in the capture position.

8. A receptacle dumping apparatus in accordance with claim 6 wherein said automatically adjustable variable length means comprises a connector having a rod movable between a retracted position and an extended position and means resiliently biasing said rod toward said retracted position.

9. A receptacle dumping apparatus in accordance with claim 8 wherein said automatically adjustable variable length means further comprises means housing one end of said rod and said resiliently biasing means, the other end of the rod being pivotally connected to selected of said capture means and said moving means and said housing means being connected to the other of said capture means and said moving means.

10. A receptacle dumping apparatus in accordance with claim 8 wherein the biasing means is a spring exerting approximately 30 pounds of biasing force on said rod.

11. A refuse collection vehicle comprising:

means defining a refuse receiving cavity, including sidewalls and a floor extending upwardly to a lower sill;

a receptacle lifter movably mounted below said sill, said lifter including means for capturing a portion of a selected type of receptacle;

means cooperatively associated with said lifter for moving said lifter between a first lifter position and a second lifter position, said lifter being located substantially entirely below a horizontal plane tangent to said sill edge and substantially entirely on the cavity side of a vertical plane tangent to said sill edge when in said first position, and said second position being above and outwardly of said sill for dumping a selected type of receptacle;

said means for moving said lifter comprising an arcuate link pivotally attached at one end to said lifter and another link pivotally attached to said vehicle and to said arcuate link at the other end;

said means for capturing a portion of a selected type of receptacle being movable between a capture position for capturing a portion of the selected type of receptacle and a release position for releasing the receptacle portion;

means cooperatively associated with said lifter moving means and said capture means for moving said capture means between said release and capture positions as said lifter moves between said first and second lifter positions;

said means for moving said capture means comprising an automatically adjustable variable length connector pivotally attached at one end to said arcuate link at a point spaced from a line connecting the end points of said arcuate link, said connector being pivotally attached to said capture means at the other end, and means resiliently biasing said connector toward a reduced length position.

12. In vehicular dumping apparatus having a refuse receiving cavity including sidewalks and a floor extending upwardly toward a rearward facing opening for receipt of refuse into the cavity, said opening defined in part, by a sill edge at a level above the ground to be engageable by an edge of a relatively tall, first type of container when the rear of the vehicle and the first type of container are moved relatively toward one another along the ground through a path of engagement at the rear of the vehicular dumping apparatus, said sill edge being adjacent to said container edge during tipping of the first type of container about said sill edge to empty its contents into the cavity, the improvement being a lifter assembly for emptying a relatively shorter second type of container, comprising:

means for releasably capturing the relatively shorter, second type of container when moved through the path of engagement at the rear of the vehicle;

means for mounting the capturing means to the rear of the vehicle for movement between a retracted position in which the capturing means is located substantially entirely below a horizontal plane tangent to said sill edge and substantially entirely on the cavity side of a vertical plan tangent to said sill edge and out of the path of engagement of the firs type of container, and a series of relatively rearward operative positions in which it extends into the path of engagement of the first type of container to capture and lift the second type of container over the sill edge and dump the contents of the second type of container over the cavity;

means for selectively driving the moveable mounting means between said retracted position and said series of operative positions; and means cooperatively associated with said driving means and said capture means to effect capturing and releasing said second type of container, including automatically adjusting variable length means connecting said capture means and said driving means, said automatically adjusting variable length connecting means being resiliently biased to a reduced length position.

13. A method of collecting refuse in a rear loading cavity of a vehicular dumping apparatus from a plurality of different, first and second types of containers, said cavity including sidewalls and floor extending upwardly toward a sill edge, said first type of container having an uppermost edge at a sufficient height to engage said sill edge, said first type of container is resting on common ground with the vehicular dumping apparatus, and said second type of container having an uppermost edge at a sufficient height to engage said sill edge, when the first type of container is resting on common ground with the vehicular dumping apparatus, and said second type of container having an uppermost edge at an insufficient elevation to engage the sill edge when resting on common ground with the vehicular dumping apparatus, comprising the steps of:

moving the vehicular dumping apparatus and the first common ground until the sill edge is engaged by the pivot edge of the first type of container;

tilting the first type of container about said sill edge to dump its contents into said cavity;

disengaging the first type of container and the vehicular dumping apparatus;

moving the vehicular apparatus and a second type of container toward one another across said common ground until the second type of container is at a loading locating rearwardly adjacent and beneath the sill edge;

actuating a powered lifting device to move a grasping member rearwardly from a retracted position substantially entirely below a horizontal plane tangent to said sill edge and substantially entirely on the cavity side of a vertical plane tangent to said sill edge, in which retracted position said powered lifting device does not interfere with the engagement of the first type of container with the sill edge, to a loading position located in the path of engagement;

grasping the second type of container at said loading position, including moving a grasping device in connection with said powered lifting device by way of an automatically adjusting linkage, said automatically adjusting linkage being resiliently biased to a reduced length position;

lifting the grasped second type of container to an elevated position in which its uppermost edge is not lower than said sill edge;

tilting the grasping second type of container when in said elected position to dump its contents into the cavity;

returning the grasped second type of container to the loading location;

returning the lifting device to the said retracted position; and moving the vehicular dumping apparatus to the next container.

14. A refuse collection vehicle comprising:

means defining a refuse receiving cavity, including a lower sill edge, sidewalls and a bottom wall sloping upwardly toward said sill edge;

a container lifter pivotally mounted below said sill edge and movable between a first lifter position and a second lifter position, said lifter being located substantially entirely below a horizontal plane tangent to said sill edge and substantially entirely on the cavity side of a vertical plane tangent to said sill edge when in said first position, to permit unobstructed access to said sill edge, and said second position being above said sill edge for dumping the contents of a container;

means for moving said lifter between said first and second positions;

said lifter further comprising a first projection fixedly attached to said lifter and a second projection movable relative to said first projection between a first position for receiving a container portion and a second position for capturing the container portion therebetween; and means for moving said second projection between said first and second positions, as said lifter moves from said first to said second positions;

an arcuate link pivotally carried by said lifter and said bottom wall and an automatically adjusting variable length means pivotally attached at one end to said second projection and pivotally attached at the other end to said arcuate link, said automatically adjusting variable length connecting means being resiliently biased to a reduced length position, said variable length means being attached to said arcuate link at a location spaced from a line connecting the pivot points of said arcuate link, said means for moving said lifter being pivotally attached to said arcuate link;

whereby said lifter is movable to the first position to permit unobstructed access to said sill edge and to the second position for capturing, lifting and dumping refuse containers.

* * * * *

UNITED STATES PATENT AND TRADEMARK OFFICE

CERTIFICATE OF CORRECTION

PATENT NO. : 5,024,573

DATED : June 18, 1991

INVENTOR(S) : Robert F. Zelinka and John W. Redding

It is certified that error appears in the above—identified patent and that said Letters Patent is hereby corrected as shown below:

Col. 1, line 27, insert --for-- before "emptying" and insert --a-- after "emptying".

Col. 8, claim 6, lines 66-67, delete "a refuse collection vehicle of the type having".

Col. 10, claim 12:
line 49, change "plan" to --plane--.
line 50, change "firs" to --first--.

Col. 11, claim 13:
line 4, insert --a-- before "floor";
line 7, after the "," delete "said" and insert --when the--;
lines 10-14, delete "a sufficient height to engage said sill edge, when the first type of container is resting on common ground with the vehicular dumping apparatus, and said second type of container having an uppermost edge at";
line 17, insert --type of container toward one another across said-- after "first".

UNITED STATES PATENT AND TRADEMARK OFFICE

CERTIFICATE OF CORRECTION

PATENT NO. : 5,024,573

DATED : June 18, 1991

INVENTOR(S) : Robert F. Zelinka and John W. Redding

It is certified that error appears in the above-identified patent and that said Letters Patent is hereby corrected as shown below:

Col. 12, claim 13, line 2, change "elected" to --elevated--.

Signed and Sealed this

Tenth Day of November, 1992

*Attest:*

DOUGLAS B. COMER

*Attesting Officer*

*Acting Commissioner of Patents and Trademarks*